US007534015B2

(12) United States Patent
Xu et al.

(10) Patent No.: US 7,534,015 B2
(45) Date of Patent: May 19, 2009

(54) LED LAMP WITH A HEAT DISSIPATION DEVICE

(75) Inventors: Fang-Wei Xu, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/942,175

(22) Filed: Nov. 19, 2007

(65) Prior Publication Data

US 2009/0052175 A1 Feb. 26, 2009

(30) Foreign Application Priority Data

Aug. 24, 2007 (CN) ..... 2007 1 0076555

(51) Int. Cl.
*F21V 29/00* (2006.01)

(52) U.S. Cl. ..... 362/373; 362/96; 362/294

(58) Field of Classification Search ..... 362/96, 362/218, 240, 294, 345, 373, 410, 800
See application file for complete search history.

(56) References Cited

U.S. PATENT DOCUMENTS

| | | | | |
|---|---|---|---|---|
| 6,815,724 | B2 * | 11/2004 | Dry | 362/373 |
| 7,314,291 | B2 * | 1/2008 | Tain et al. | 362/373 |
| 2005/0174780 | A1 * | 8/2005 | Park | 362/294 |
| 2008/0032254 | A1 * | 2/2008 | Plank et al. | 362/294 |
| 2008/0055909 | A1 * | 3/2008 | Li | 362/294 |
| 2008/0247136 | A1 * | 10/2008 | Peng et al. | 361/697 |

* cited by examiner

*Primary Examiner*—Y My Quach Lee
(74) *Attorney, Agent, or Firm*—Frank R. Niranjan

(57) ABSTRACT

An LED lamp includes a hollow, prism-shaped heat sink (30), a plurality of LED modules (20) attached on sidewalls (320) of the heat sink, a cover (40) mounted on a top of the heat sink, a lampshade (10) secured to a bottom of the heat sink, and a fan (50) fixed on the top of the heat sink and through the cover. A plurality of fins (340) extends inwardly from inner faces of the heat sink to cooperatively define two crossed slots in the heat sink. When the fan is in operation, an airflow produced by the fan flows through the fins from the top through the bottom of the heat sink, thereby dissipating heat absorbed by the heat sink from the LED modules rapidly and efficiently.

19 Claims, 4 Drawing Sheets

LED LAMP WITH A HEAT DISSIPATION DEVICE

BACKGROUND OF THE INVENTION

1. Field of the Invention

The present invention relates to a light emitting diode (LED) lamp, and more particularly to an LED lamp incorporating a heat sink and an electric fan for improving heat dissipation of the LED lamp.

2. Description of Related Art

As an energy-efficient light, an LED lamp has a trend of substituting for the fluorescent lamp for indoor and outdoor lighting purpose; in order to increase the overall lighting brightness, a plurality of LEDs are often incorporated into a signal lamp, in which how to efficiently dissipate heat generated by the LEDs becomes a challenge.

Conventionally, an LED lamp comprises a cylindrical enclosure functioning as a heat sink and a plurality of LEDs mounted on an outer wall of the enclosure. The LEDs are arranged in a plurality of lines along a height direction of the enclosure and around the enclosure. The enclosure defines a central through hole oriented along the height direction thereof. When the LEDs are activated to lighten, heat generated by the LEDs is dispersed to ambient air via the enclosure by natural air convection.

However, in order to achieve a higher lighting intensity, the LEDs are arranged into a number of crowded groups, whereby the heat generated by the LEDs is concentrated at discrete spots, which leads to an uneven heat distribution over the enclosure. The conventional enclosure is not able to dissipate the locally-concentrated and unevenly-distributed heat timely and efficiently, whereby a heat accumulation occurs in the enclosure easily. Such a heat accumulation may cause the LEDs to overheat and to have an unstable operation or even a malfunction.

What is needed, therefore, is an LED lamp which can overcome the above-mentioned disadvantages.

SUMMARY OF THE INVENTION

An LED lamp includes a hollow prism-shaped heat sink, a plurality of LED modules attached on sidewalls of the heat sink, a cover mounted on a top of the heat sink, a lampshade secured to a bottom of the heat sink, and a fan fixed on the top of the heat sink and through the cover. A plurality of fins extends inwardly from inner faces of the heat sink to cooperatively define two crossed slots in the heat sink. When the fan is in operation, an airflow produced by the fan flows through the fins from the top of the heat sink through the bottom of the heat sink, thereby dissipating heat absorbed by the heat sink from the LED modules rapidly and efficiently. Accordingly, LEDs of the LED modules can work within their predetermined temperature range.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
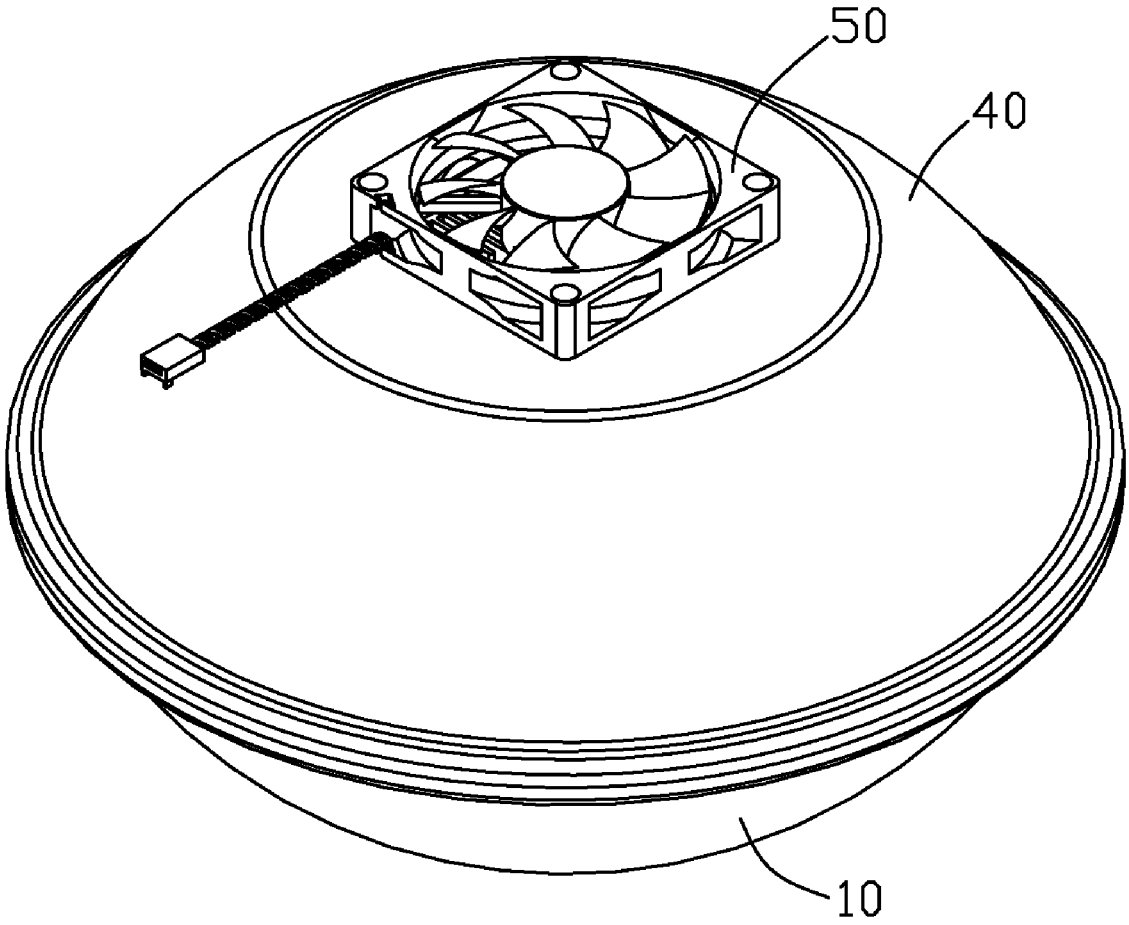
FIG. 1 is an assembled, isometric view of an LED lamp with a heat dissipation device in accordance with a preferred embodiment of the present invention.
Figure 2:
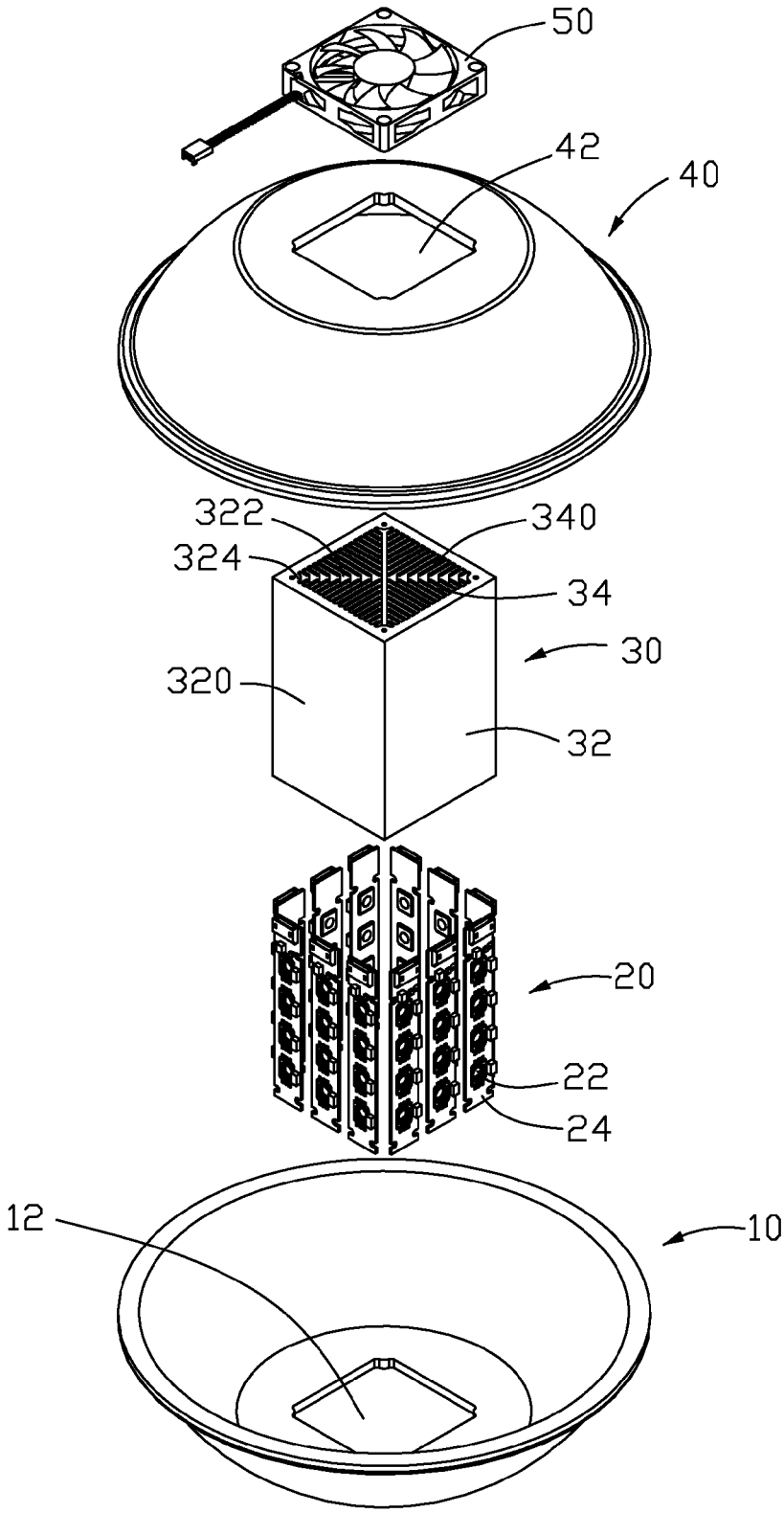
FIG. 2 is an exploded view of FIG. 1.

Referring to FIGS. 1 and 2, an LED lamp comprises a heat sink 30, a plurality of LED modules 20 attached on a periphery of the heat sink 30, a lampshade 10 secured to a bottom of the heat sink 30, and a cover 40 and a fan 50 fixed to a top of the heat sink 30.

Figure 4:
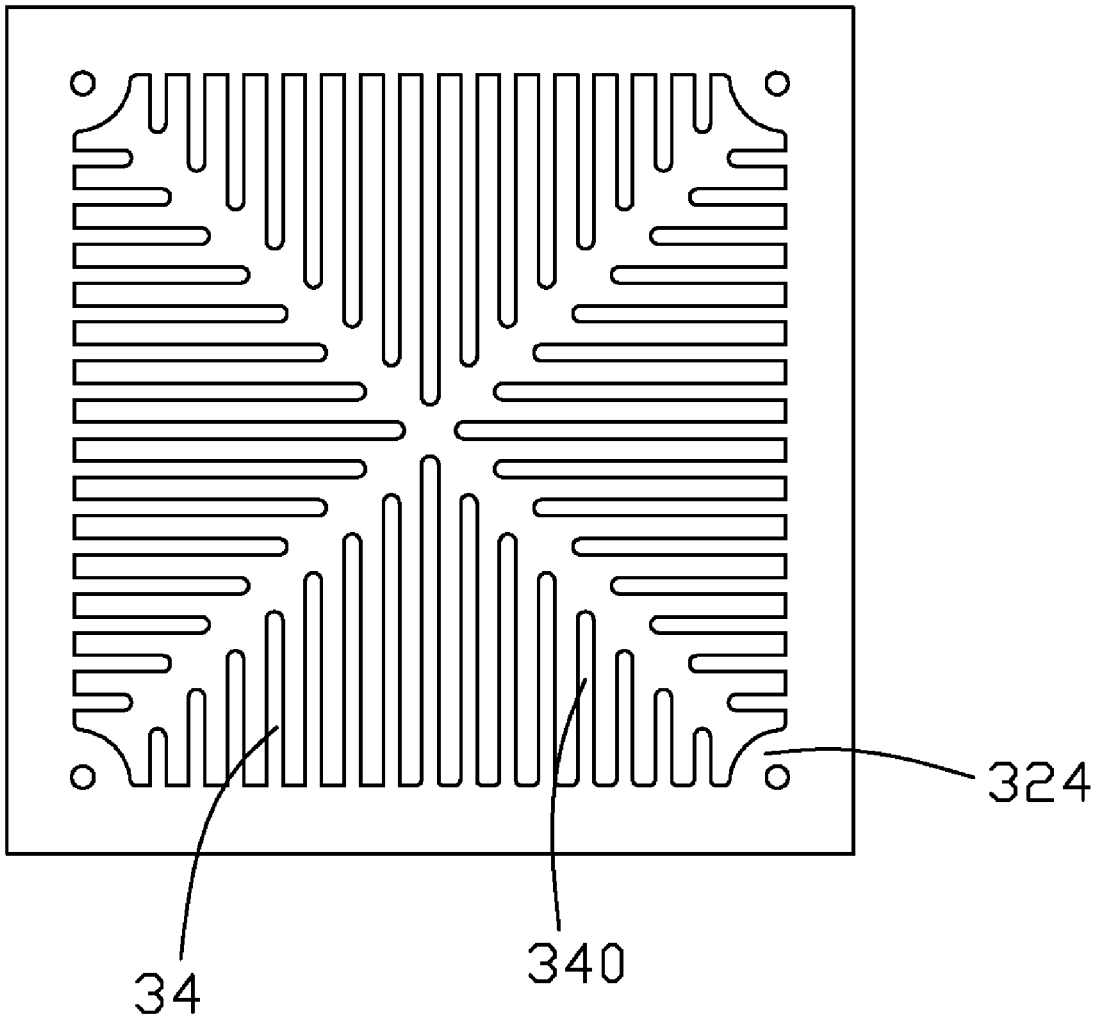
FIG. 4 is a cross-sectional view of the heat sink of FIG. 3.

Also shown in FIG. 4, the heat sink 30 is made of metal such as copper, aluminum, or an alloy thereof. The heat sink 30 comprises a square prism 32, which has four identical and rectangular sidewalls 320, and a through hole 322 defined from a bottom to a top of the square prism 32 along a height direction of the heat sink 30, thereby defining a top opening (not labeled) at the top of the square prism 32, and a bottom opening (not labeled) at the bottom of the square prism 32. The through hole 322 has a square cross-section so as to have four inner faces (not labeled) for the square prism 32, wherein each of the inner faces is oriented perpendicular to an adjacent one of the inner faces, and parallel to an outer face (not labeled) of a corresponding one of the sidewalls 320. A post 324 is formed at a junction of every two adjacent ones of the inner faces with a threaded hole (not labeled) defined at a top face thereof for threadedly receiving a screw (not shown) therein.

Referring to FIG. 4, four fin groups 34 extend inwardly and perpendicularly from the four inner faces of the square prism 32 respectively, wherein each of the four fin groups 34 comprises a plurality of evenly spaced fins 340 between two adjacent posts 324. Each fin 340 extends from the bottom to the top of the square prism 32. The plurality of fins 340 in each fin group 34 have gradually decreasing lengths from a middle toward two laterals of a width of each inner face of the square prism 32, whereby the plurality of fins 340 in each group has a triangular configuration as viewed from the top or the bottom of the heat sink 30. Each of the four fin groups 34 has a configuration which is symmetrical with that of an adjacent fin group 34 in respect to a diagonal of the square prism 32, wherein an extremity of each of the plurality of fins 340 of each fin group 34 is spaced a distance from that of a corresponding fin 340 of an adjacent fin group 34; thus, the extremities of the fins 340 of the four fin groups 34 cooperatively define two crossed slots (not labeled) in the heat sink 30. The two crossed slots communicate with gaps (not labeled) between adjacent ones of the plurality of fins 340 to define passages for an airflow through the heat sink 30.

Figure 3:
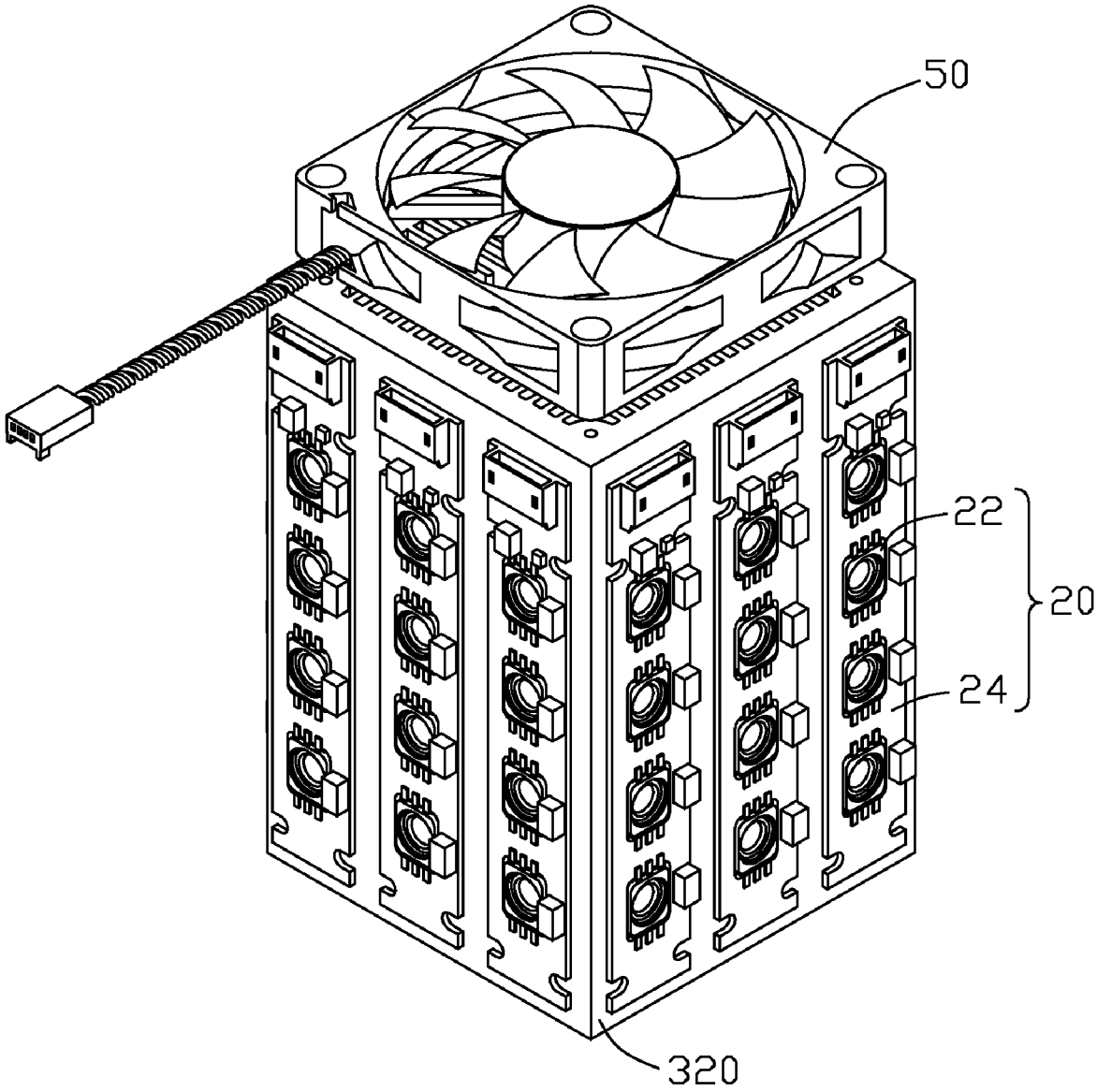
FIG. 3 is an assembled view of a heat sink, a fan, and LED modules of the LED lamp of FIG. 1.

Shown in FIG. 3, the LED modules 20 are secured on the sidewalls 320 of the square prism 32. Each of the LED modules 20 comprises a rectangular printed circuit board 24 and a plurality of LEDs 22 arranged on a front face (not labeled) of the printed circuit board 24 along a lengthwise orientation of the printed circuit board 24. Three LED modules 20 are fixed on each of the four sidewalls 320 along the height direction of the heat sink 30 by having a rear face (not shown) of the printed circuit board 24 contacting the outer face of the each of the four sidewalls 320, so that heat generated by the LEDs 22 can be conducted to the heat sink 30 via the printed circuit board 24. The LED module 20 can be fixedly attached to the heat sink 30 by a know manner, for example, gluing.

Referring to FIG. 2 again, the cover 40 is for being attached to a top face (not labeled) of the four sidewalls 320 of the square prism 32, and the lampshade 10 is for being attached to a bottom face (not shown) of the four sidewalls 320 of the square prism 32, thereby sandwiching the heat sink 30 therebetween. The cover 40 and the lampshade 10 respectively define two openings 12, 42 for communicating with the top opening and the bottom opening of the square prism 32. Each of the two openings 12, 42 has an area almost similar to that of each of the top opening and the bottom opening of the square prism 32.

The fan 50 occupies an area similar to the top opening of the square prism 32. The fan 50 extends through the opening 42 of the cover 40 and is fixed on top portions of the four fin groups 34 by extending screws through holes (not labeled) of the fan 50 to engage in the threaded holes of the posts 324 of the square prism 32, in such a manner that an airflow outlet of the fan 50 is oriented towards the heat sink 30, whereby the airflow exerted by the fan 50 can flow through the square prism 32 to cool the heat sink 30.

In use, when the LEDs 22 are activated to lighten, the heat generated from the LEDs 22 is conducted to the sidewalls 320 of the heat sink 30 via the printed circuit board 24. The airflow engendered by the fan 50 passes through the four inner faces and the four fin arrangements 34 of the heat sink 30 via the top opening and the bottom opening of the square prism 32, and brings the heat absorbed by the heat sink 30 to the ambient air rapidly and efficiently, thereby preventing a heat accumulation from occurring in the heat sink 30. Therefore, the LED lamp has an improved heat dissipating capability for preventing the LEDs 22 from overheating.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a prism-shaped heat sink having a plurality of sidewalls, and a hole defined through the heat sink from a bottom to a top thereof;

a plurality of LED modules being attached on the plurality of sidewalls of the heat sink respectively;

a cover being mounted at the top of the heat sink to receive the heat sink therein; and a fan being fixed on the top of the heat sink and having an airflow outlet oriented toward the heat sink, wherein the fan extends through the cover to be exposed out of the cover, and wherein when the fan is in operation, an airflow produced by the fan flows through the heat sink via the hole so as to cool the LED lamp.

2. The LED lamp as claimed in claim 1, wherein the heat sink has four sidewalls.

3. The LED lamp as claimed in claim 1, wherein the hole has a rectangular cross-section to define four inner faces for the heat sink.

4. The LED lamp as claimed in claim 3, wherein the heat sink further comprises a plurality of fins extending inwardly from each of the four inner faces thereof, and wherein the plurality of fins extends from the top to the bottom of the heat sink.

5. The LED lamp as claimed in claim 4, wherein the plurality of fins have gradually decreasing heights from a middle to two laterals of a width of the each of the four inner faces.

6. The LED lamp as claimed in claim 5, wherein the plurality of fins extending from one of the four inner faces is symmetrical to another plurality of fins extending from an adjacent one of the four inner faces in respect to a diagonal of the heat sink between the one and the adjacent one of the four inner faces.

7. The LED lamp as claimed in claim 6, wherein a distal end of each of the plurality of fins is spaced a distance from a distal end of a corresponding one of the another plurality of fins.

8. The LED lamp as claimed in claim 7, wherein the plurality of fins is spaced from each other with gaps defined therebetween adjacent ones thereof, the distal ends of the fins on the four inner faces cooperatively defining two crossed slots communicating with the gaps for providing passages for the airflow through the heat sink.

9. The LED lamp as claimed in claim 4, wherein the fan is secured on top portions of the fins and substantially covers the hole of the heat sink.

10. The LED lamp as claimed in claim 9 further comprising a lampshade attached to the bottom of the heat sink, wherein the cover and the lampshade sandwich the heat sink therebetween.

11. The LED lamp as claimed in claim 10, wherein the cover defines an opening, and the lampshade defines another opening corresponding to the opening of the cover, the fan extending through the opening of the cover to connect the top portions of the fins of the heat sink, and the another opening of the lampshade communicating with the hole of the heat sink for allowing the airflow to flow out of the heat sink.

12. The LED lamp as claimed in claim 11, wherein a top opening and a bottom opening are defined in the heat sink, the opening in the cover and the another opening in the lampshade each having an area similar to that of each of the top opening and the bottom opening in the heat sink.

13. A heat dissipation device for dissipating heat from LED modules, comprising:

a hollow heat sink having a plurality of sidewalls adapted for mounting the LED modules thereon, a plurality of inner faces located inside of the sidewalls, respectively, and a plurality of fins extending inwardly from each of the inner faces;

a cover and a lampshade being mounted at a top face and a bottom face of the heat sink, respectively, the heat sink being located inside of the cover and the lampshade; and a fan being mounted on top portions of the plurality of fins and extending through the cover to be exposed out of the cover, wherein when the fan is in operation, an airflow produced by the fan passes through the plurality of fins and flows out of the heat sink from bottom portions of the fins.

14. The heat dissipation device as described in claim 13, wherein the heat sink has a quadrangular prism to form four sidewalls for the heat sink, and a rectangular through hole defined in the quadrangular prism to define four inner faces for the heat sink.

15. The heat dissipation device as described in claim 13, wherein the plurality of fins extending from one of the plurality of inner faces of the sidewalls of the heat sink defines a triangular configuration as viewed from one of top and bottom ends of the heat sink.

16. The heat dissipation device as described in claim 15, wherein distal ends of the fins extending from the plurality of inner faces cooperatively define two crossed slots in the heat sink.

17. The heat dissipation device as described in claim 13, wherein each of the plurality of fins extends from a bottom to a top along a height direction of the heat sink.

18. An LED lamp comprising:

a heat sink having an outer face and an inner hole defined therethrough, wherein a plurality of fins is formed in the inner hole and connects with the heat sink;

a plurality of LED modules each having a printed circuit board and an LED mounted on the printed circuit board, being attached to the outer face of the heat sink;

a cover and a lampshade respectively mounted at a top face and a bottom face of the heat sink, the cover and the lampshade cooperatively receiving the heat sink therein; and a fan mounted on an end of the heat sink and extending through the cover to be exposed out of the cover, wherein when the fan is activated, an airflow is generated by the fan and flows through the fins.

19. The LED lamp as claimed in claim 18, wherein the heat sink has a configuration of a quadrangular prism, and the fins define two crossed slots in the heat sink.

* * * * *